United States Patent [19]

Conley et al.

[11] Patent Number: 4,676,034

[45] Date of Patent: Jun. 30, 1987

[54] ROOF STRUCTURE

[75] Inventors: John L. Conley; Thomas L. Conley; Gerald D. Conley; Howard L. Davis, all of Chino, Calif.

[73] Assignee: Conley's Manufacturing & Sales, Pomona, Calif.

[21] Appl. No.: 312,531

[22] Filed: Oct. 19, 1981

[51] Int. Cl.[4] ..... E04D 13/00

[52] U.S. Cl. ..... 52/11

[58] Field of Search ..... 52/11, 13, 14, 465, 52/468, 469, 461, 462

[56] References Cited

U.S. PATENT DOCUMENTS

| | | | |
|---|---|---|---|
| 3,344,564 | 10/1967 | Siegal | 52/13 X |
| 3,488,899 | 1/1970 | Schultz et al. | 52/14 |
| 4,194,325 | 3/1980 | Chalpin, Jr. | 52/14 |

*Primary Examiner*—Carl D. Friedman

*Attorney, Agent, or Firm*—Boniard I. Brown

[57] ABSTRACT

A roof structure which includes a plurality of first structural members disposed in spaced generally parallel relationship. Each of the first generally parallel members carry an associated roofing material and each has a trough shaped lip disposed proximate to the associated roofing material with the concave face thereof facing the associated roofing material. A plurality of second structural members are disposed in spaced generally parallel relationship and disposed in generally perpendicular relationship to the first structural members. The second structural members each have a trough shaped member having a concave face disposed facing the associated roofing material. The second structural members are each disposed at a lower elevation than at least a part of the first structural members. Structure is provided for directing condensate from the lip of each of the first structural members to at least one of the trough shaped members.

13 Claims, 5 Drawing Figures

ROOF STRUCTURE

BACKGROUND OF THE INVENTION

The invention relates to building construction and particularly to a roof construction. While having particular application to greenhouses it will be understood to also have application to other structures where substantial condensation may be encountered. Examples of such structures include swimming pool enclosures and envelope style homes wherein essentially a home is surrounded by an outer envelope to reduce heating requirements.

The prior art includes roof structures such as those shown in U.S. Pat. No. 3,488,899. Such structures have not been wholly satisfactory because they are relatively heavy and expensive. In addition, the manner in which condensate is directed to drains is not as effective as is desirable.

It is an object of the invention to provide apparatus which is less expensive than competitive structures.

It is another object of the invention to provide a strong structure which will require substantially one third less material and thus will weigh substantially less.

Another object is to provide apparatus which will require less securing bolts than other prior art apparatus.

Yet another object of the invention is to provide apparatus which will require less labor to assemble than earlier structures.

Still another object of the invention is to provide a structure in which there is a reduced probability of condensate dripping directly from the roofing material to the enclosed area below instead of running through predetermined channels to gutters and the like.

SUMMARY OF THE INVENTION

The foregoing objects and other objects and advantages which shall become apparent from the detailed description of the preferred embodiment are attained in a roof structure which includes a plurality of first structural members disposed in spaced generally parallel relationship, each of the first generally parallel members each carrying an associated roofing material and each has a trough shaped lip disposed proximate to the associated roofing material with the concave face thereof facing the associated roofing material. A plurality of second structural members are disposed in spaced generally parallel relationship and are also disposed in generally perpendicular relationship to the first structural members. The second structural members each have a trough shaped member having a concave face disposed in facing relationship to the associated roofing material. The second structural members each are disposed at a lower elevation than at least a part of the first structural members. Means are provided for directing condensate from the lip of each of the first structural members to at least one of the trough shaped members.

The trough shaped lip of each of the first structural members may be disposed nearer to the associated roofing material than substantially all of the remainder of each of the first structural members. The means for directing condensate may comprise a slot disposed at, at least, one axial location in the trough shaped lip. The lip may be disposed in generally aligned relationship with the trough shaped member. A member may extend intermediate the trough shaped lip via the slot to the trough shaped member. The member extending from the trough shaped lip to the trough shaped member may be a wire. The wire may include axial extremities which may be disposed in the trough shaped lip and which may extend in opposite directions. The wire may further include a generally U-shaped axial section intermediate the axial extremities. A gutter may be disposed at an axial extremity of each of the second structural members. The first structural members are purlins and the second structural members are rafters.

BRIEF DESCRIPTION OF THE ACCOMPANYING DRAWING

DESCRIPTION OF THE PREFERRED EMBODIMENT

Figure 1:
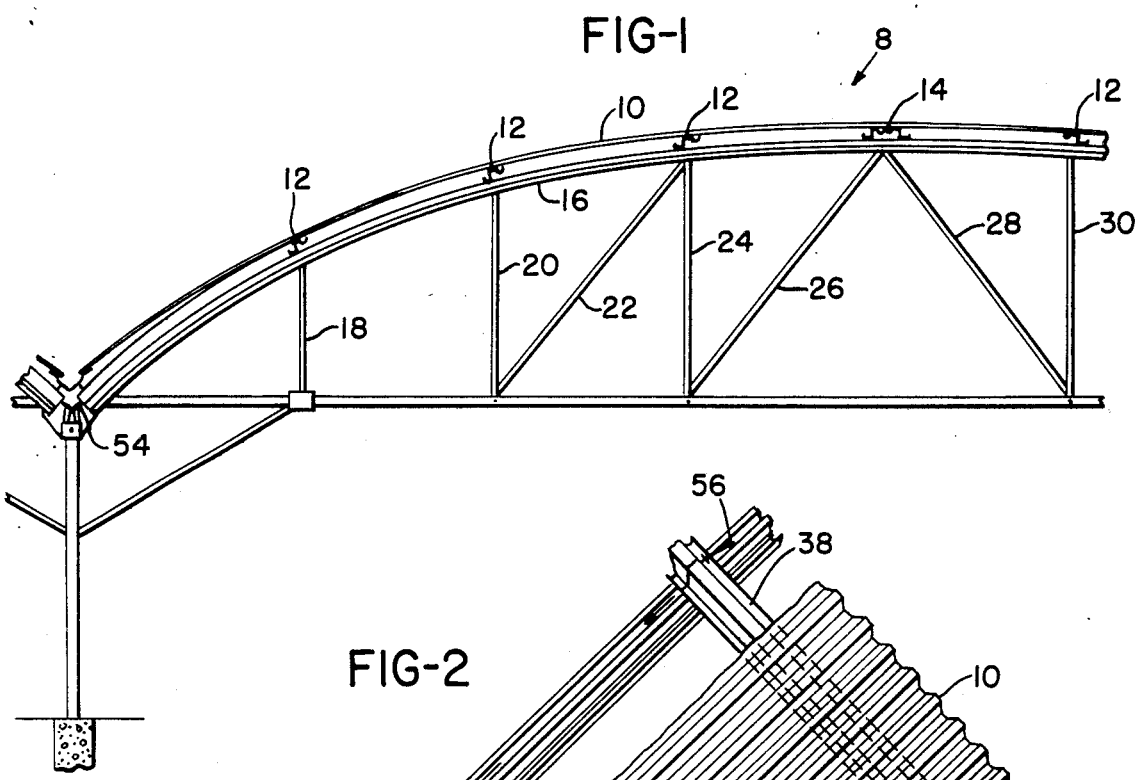
FIG. 1 is a partial, simplified elevational view of the basic structure of a building utilizing the apparatus in accordance with the invention.

Referring now to FIGS. 1–5, there is shown a roof construction 8 which includes corrugated fiberglass 10 which is supported on a plurality of purlins 12. A ridge pole 14 is disposed intermediate two purlins 12 at the geometric center line of the roof 8. Disposed in spaced generally parallel relationship are a plurality of second structural members or rafters 16. The rafters 16 are also referred to as arch rafters.

The arch rafter 16 illustrated in FIG. 1, is supported by struts 18, 20, 22, 24, 26, 28 and 30. The construction of the ends of the structs 22, 24 is best seen in FIGS. 3 and 4, and this construction is typical of that used elsewhere in the apparatus 8.

Figure 4:
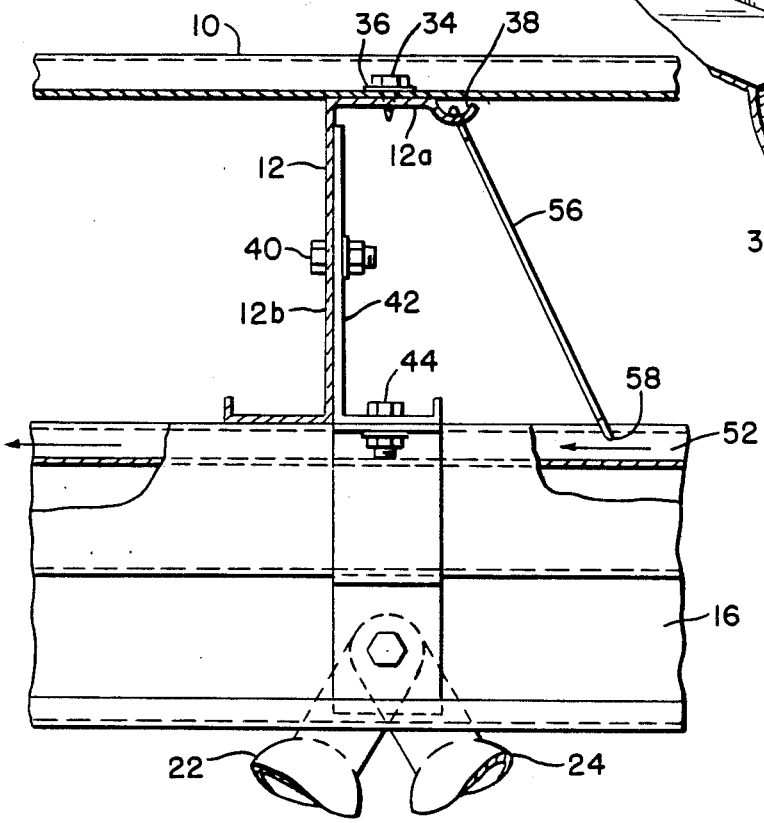
FIG. 4 is a sectional view taken along the line 4—4 of FIG. 3.
Figure 5:
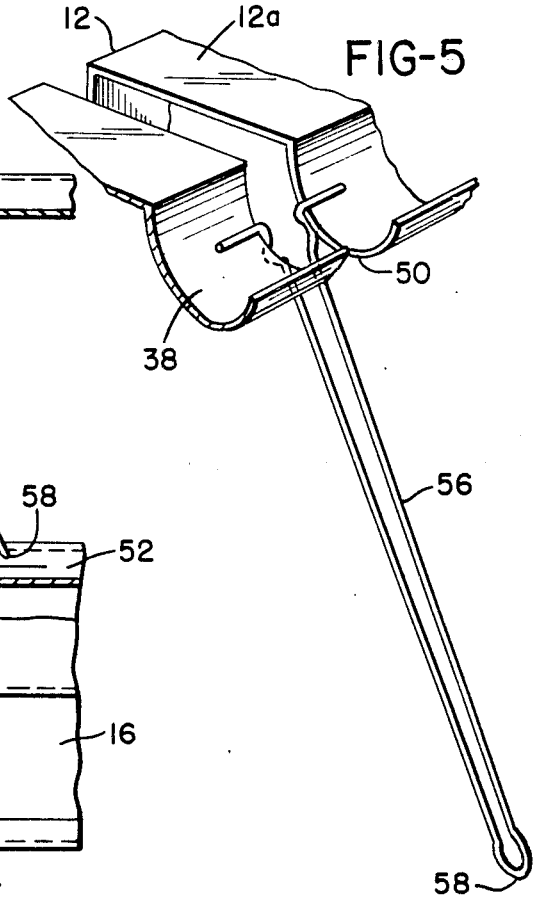
FIG. 5 is a fragmentary perspective view of the trough shaped lip which is a part of the purlin illustrated in FIG. 3.

The fiberglass sections 10 are fastened to the purlin 12 by means of a self tapping screw 34 and a washer 36, as best seen in FIG. 4.

Each purlin 12 includes a trough shaped lip 38 which is disposed in closely spaced realtionship to the fiberglass roofing material 10. This spacing is particularly advantageous in that it ensures that the condensate, which naturally forms on the interior surface of the fiberglass sections 10 and which moves by gravity down the panels 10 toward the purlins 12, is immediately received and trapped in the trough shaped lip 38. Ordinarily the lip 38 will be disposed on the side of the purlin 12 nearest to the ridge pole 14 so that it will receive the condensate passing by the action of gravity toward the lowest point on the roof assembly 8. The construction of the purlin 12 is such that it has a generally S-shaped cross section, as best seen in FIGS. 3 and 4. The S-shaped cross section includes a leg **12*a* which is generally parallel to the lower face of the fiberglass roofing material 10, as best seen in FIG. 4. Thus, the condensate passing along the lower surface of the fiberglass material cannot pass beyond the purlin and is forced into the trough shaped lip 38. The purlin 12 further includes a generally vertical (as viewed in FIG. 4) section 12*b* which is secured by bolts 40** to a bracket 42 which is secured by additional bolts 44 to the arch rafter 16. The bracket 42 has a generally U-shaped configuration as best seen in FIGS. 3 and 4. The trough shaped lip 38 has, disposed at axially spaced intervals, slots 50 (one shown) which are disposed in generally aligned relationship with a trough shaped member 52 which is part of the arch rafter 16. Disposed in the slot 50 is a shaped wire member 56 which has axial extremities extending in opposite direction in the bottom of the trough shaped lip 38 and which has an intermediate generally U-shaped axial section 58 which extends to and ordinarily contacts the trough shaped member 52.

Figure 3:
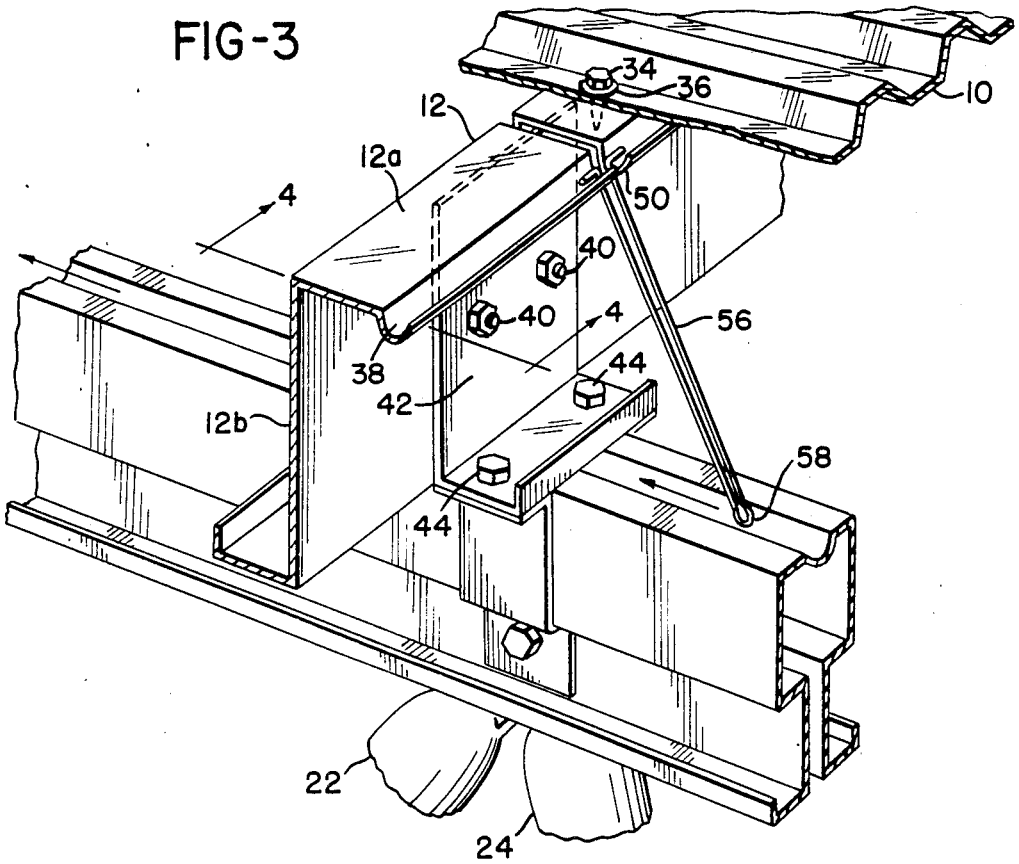
FIG. 3 is a fragmentary perspective view of the apparatus illustrated in FIG. 1 and illustrating in greater detail the relationship between fiberglass roofing material, a supporting purlin and a cooperating rafter.

The trough shaped member 52 has a generally rectangular cross-section and a pair of generally parallel depending sections which are best illustrated in FIG. 3. The arch rafters 16 are, as are the purlins 12, ordinarily manufactured by an extrusion process.

Figure 2:
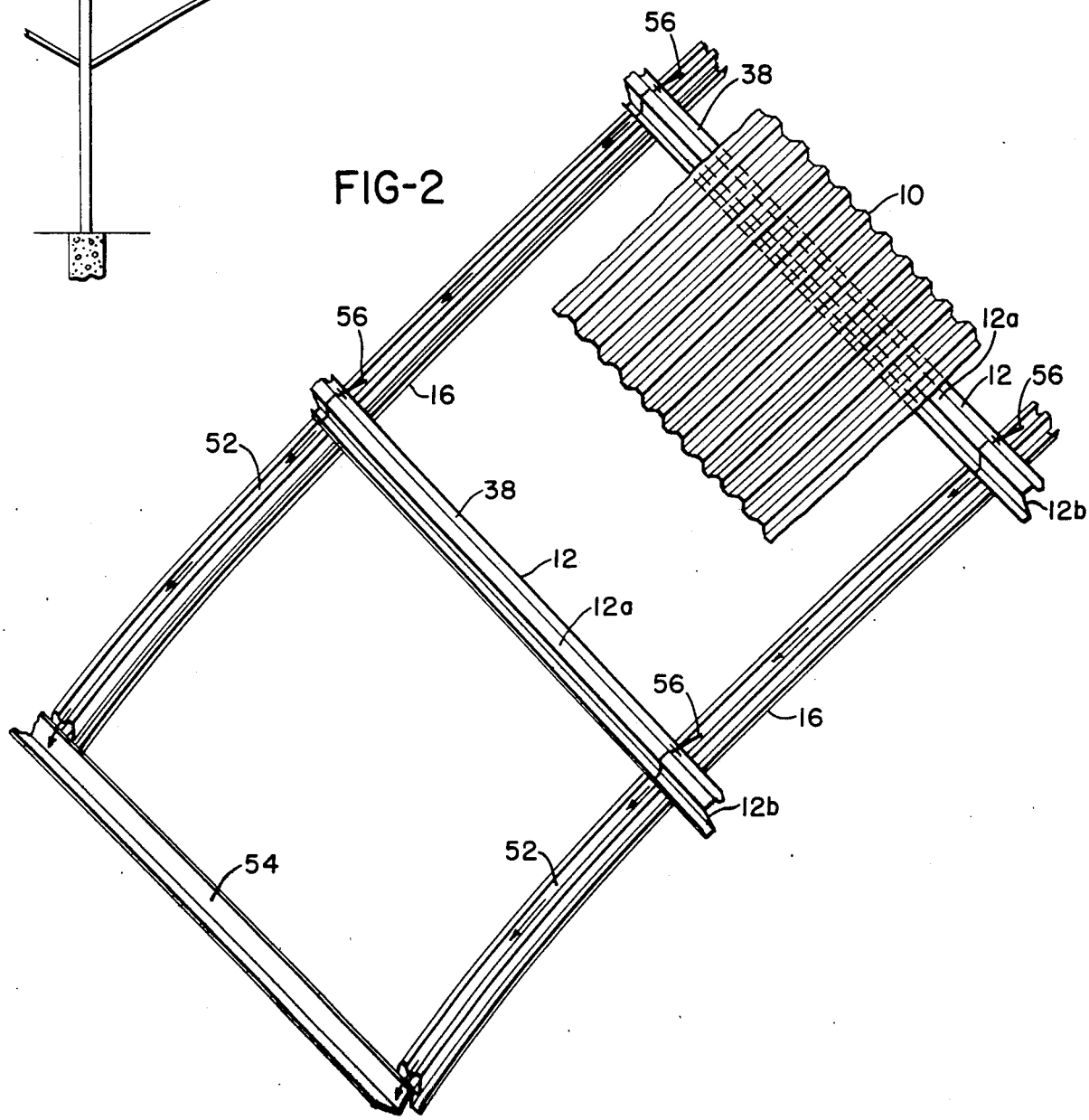
FIG. 2 is a fragmentary perspective view of a portion of the roof structure illustrated in FIG. 1.

In operation, the condensate forming on the lower surface of the fiberglass sections 10 is trapped in the trough shaped lip 38 where it builds up until it flows down through the slot 50. The effects of surface tension cause it to follow the wire section 56 and then on to the wire section 58 and thence into the trough shaped member 52. From the trough shaped member 52 the condensate flows, as best seen in FIG. 2, to the gutter 54 which is also shown in FIG. 1. From the gutter 54 the condesnate is directed by downspouts (not shown) to storm sewers or other locations where its discharge is not objectionable.

The invention has been described with reference to its illustrated preferred embodiment. Persons skilled in the art of constructing roof structures may, upon exposure to the teachings herein, conceive variations in the mechanical development of the components therein. Such variations are deemed to be encompassed by the disclosure, the invention being delimited only by the appended claims.

We claim:

1. A roof structure for cooperation with associated roofing material, which comprises:

a plurality of first structural members disposed in spaced generally parallel relationship, each of said first generally parallel members each carrying the roofing material and each having a trough shaped lip disposed proximate to the roofing material with the concave face thereof facing the roofing material;

a plurality of second structural members disposed in spaced generally parallel relationship and also disposed in generally perpendicular relationship to said first structural members, said second structural members each having a trough shaped member having a concave face disposed in facing relationship to the roofing material, said second structural members each being disposed at a lower elevation than at least a part of said first structural members;

means for directing condensate from said trough shaped lip of each of said first structural members to at least one of said trough shaped members, said trough shaped lip of each of said first structural members being disposed nearer to the roofing material than substantially all of the remainder of each of said first structural members;

said means for directing condesnate comprises an aperture disposed at at least one axial location in said trough shaped lip which is disposed in generally algined relationship with said trough shaped member; and a guide member extending intermediate said trough shaped lip via said aperture to said trough shaped member, said guide member extending fromn said trough shaped lip to said trough shaped member being a wire.

2. The apparatus as described in claim 1, wherein:

said wire includes axial extremities which extend in opposite directions from said slot in said trough shaped lip.

3. The apparatus as described in claim 2, wherein:

said wire furtehr includes a generally U-shaped axial section intermediate said axial extremities.

4. The apparatus as described in claim 1, 2, or 3, further including:

a gutter disposed at the axial extremity of each of said second structural members.

5. The apparatus as described in claim 1, wherein:

said first structural members are purlins.

6. The apparatus as described in claim 5, wherein:

said second structural members are rafters.

7. A roof structure for cooperation with associated roofing material, which comprises:

a plurality of first structural members disposed in spaced generally parallel relationship, each of said first generally parallel members each carrying the roofing material and each having a trough shaped lip disposed pxoimate to the roofing material with the concave face thereof facing the roofing material;

a plurality of second structural members disposed in spaced generally parallel relationship and also disposed in generally perpendicular relationship to said first structural members, each of said second structural members extending across a plurality of said first structural members, said second structural members each having a trough shaped member having a concave face disposed in facing relationship to the roofing material, said second structural members each being disposed at a lower elevation than at least a part of said first structural members;

means for directing condensate from said lip of each of said first structural members to at least one of said trough shaped members; and said trough shaped lip of each of said first structural members is disposed nearer to the roofing material than substantially all of the remainder of each of said first structural members.

8. The apparatus as described in claim 7, wherein:

said means for direction condensate comprises an aperture disposed at at least one axial location in said trough shaped lip which is disposed in generally aligned relationship with said trough shaped member.

9. The apparatus as described in claim 8, wherein said means for directing condensate comprises:

a guide member extending intermediate said trough shaped lip via said slot to said trough shaped member.

10. The apparatus as described in claim 9, wherein:

said guide member extending from said trough shaped lip to said trough shaped member is a wire.

11. The apparatus as desdribed in claim 10, wherein:

said wire includes axial extremities which extend in opposite directions from said slot in said trough shaped lip.

12. The apparatus as described in claim 11, wherein:

said wire further includes a generally U-shaped axial section intermediate said axial extremities.

13. The apparatus as described in claim 7, 8, 9, 10, 11, or 12, further including:

a gutter disposed at the axial extremity of each of said second structural members.

* * * * *